US007121654B2

(12) United States Patent
Matsumoto et al.

(10) Patent No.: US 7,121,654 B2
(45) Date of Patent: Oct. 17, 2006

(54) LIQUID EJECTION APPARATUS

(75) Inventors: Hitoshi Matsumoto, Nagano (JP); Shinichiro Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 53 days.

(21) Appl. No.: 10/695,446

(22) Filed: Oct. 29, 2003

(65) Prior Publication Data

US 2004/0145625 A1 Jul. 29, 2004

(30) Foreign Application Priority Data

Oct. 30, 2002 (JP) ..... P2002-316094

(51) Int. Cl.
*B41J 2/175* (2006.01)
*B41J 2/14* (2006.01)

(52) U.S. Cl. ..... 347/86; 347/49; 347/50

(58) Field of Classification Search ..... 347/37, 347/49, 50, 86; 400/175, 352
See application file for complete search history.

(56) References Cited

U.S. PATENT DOCUMENTS 5,428,378 A * 6/1995 Murata et al. ..... 347/19
5,539,436 A * 7/1996 Wilson et al. ..... 347/37
6,039,428 A 3/2000 Juve
2002/0149646 A1 10/2002 Winthrop et al.

FOREIGN PATENT DOCUMENTS

| | | | |
|---|---|---|---|
| EP | 1223037 | A | 7/2002 |
| JP | 05/016379 | A | 1/1993 |
| JP | 2002/001980 | A | 1/2002 |
| WO | WO 98/55320 | A1 | 12/1998 |

* cited by examiner

*Primary Examiner*—Shih-Wen Hsieh

(57) ABSTRACT

A liquid ejection apparatus including a liquid supply unit having a supply unit case for accommodating a liquid charging portion, and a main body having a supply unit arranging part for arranging the liquid supply unit and a carriage part for moving along the vicinity of the supply unit arranging part, wherein the carriage side of the liquid supply unit arranged in the supply unit arranging part is provided with an information storing unit mounting portion formed to be protruded toward the carriage side, the supply unit arranging part is provided with a through window portion for causing the information storing unit mounting portion to penetrate therethrough, and carriage side information storing unit is formed in a portion corresponding to the through window portion in the carriage part for moving in the vicinity of the through window portion.

17 Claims, 16 Drawing Sheets

LIQUID EJECTION APPARATUS

BACKGROUND OF THE INVENTION

1. Field of the Invention

The present invention relates to a liquid ejection apparatus such as an image recording apparatus, for example, a printer.

2. Related Art

In general, a printer to be an ink jet type recording apparatus has an ink cartridge mounted on a carriage including an ink jet type recording head and employs a method in which the ink jet type recording head carries out printing upon receipt of the supply of an ink from the ink cartridge.

However, the printer of this kind has the capacity of the ink cartridge to be mounted on the carriage which is small, and cannot correspond to a comparatively large amount of printing for an office or business, for example. For this reason, there has been employed a method in which the ink cartridge is not provided on the carriage but on the ink jet recording apparatus body side, and a subtank is mounted on the carriage to supply an ink from the ink cartridge to the subtank (for example, see Japanese Patent Publication No. JP-A-2002-1980, FIG. 1).

Moreover, the ink jet type recording head provided in the printer has such a structure as to receive data on the type and residual amount of an ink charged in the ink cartridge, a serial number and an expiration date from the ink cartridge, thereby ejecting the ink properly.

For this reason, the ink cartridge is provided with an IC chip storing the data and a communicating portion for transferring the data in contact with the IC chip is provided in the printer. The communicating portion has such a structure as to be connected to the ink cartridge.

More specifically, the IC chip of the ink cartridge has such a structure as to supply data on the type of the ink to the printer through the connecting terminal of the communicating portion.

When the connecting terminal of the communicating portion is to transfer data together with the IC chip of the ink cartridge, they are to come in contact with each other.

For this reason, the data cannot be transferred until the position of the IC chip of the ink cartridge and that of the connecting terminal of the communicating portion are accurately set. Therefore, there is a problem in that the positioning is to be carried out accurately.

Moreover, data are varied every ink cartridge. Therefore, it is necessary to provide, in the communicating portion, the same number of connecting terminals as the number of the ink cartridges. Consequently, there is also a problem in that a cost cannot be reduced.

On the other hand, there is also a problem in that precision in the transfer of information is reduced when the information is transferred in non-contact without using the connecting terminal.

SUMMARY OF THE INVENTION

In consideration of the above respects, it is an object of the invention to provide a liquid ejection apparatus capable of transmitting information from a liquid supply unit to a liquid ejection apparatus body in non-contact with high precision without increasing a cost.

In order to attain the object, the invention provides a liquid ejection apparatus comprising a supply unit arranging part for arranging a liquid supply unit, and a carriage part for accommodating a liquid ejection head and moving along a vicinity of the supply unit arranging part, wherein a carriage side communication device for communicating a supply unit communication portion provided in the liquid supply unit is formed in a portion corresponding to the supply unit arranging part of the carriage part for moving in the vicinity of the supply unit arranging part.

According to the structure, the supply unit communication portion mounting portion is provided on the liquid supply unit arranged in the supply unit arranging part, and the carriage side communication device is formed in the portion corresponding to the supply unit arranging part of the carriage part for moving in the vicinity of the supply unit arranging part.

Consequently, the supply unit communication portion mounting portion provided in the supply unit communication portion mounting portion and the carriage side communication device are close to each other. Therefore, a mutual information transfer can be reliably carried out with high precision.

Thus, it is possible to provide a liquid ejection apparatus capable of transmitting information from the liquid supply unit to the liquid ejection apparatus body in non-contact with high precision without increasing a cost.

Preferably, the liquid ejection apparatus is characterized in that the supply unit arranging part is provided with a through window portion corresponding to the supply unit communication portion, and the carriage side communication device is formed in a portion corresponding to the through window portion of the carriage part for moving in the vicinity of the through window portion.

According to the structure, the supply unit arranging part is provided with the through window portion through which a convex portion (mounting portion) having the supply unit communication portion penetrates.

Consequently, the supply unit communication portion provided in the supply unit communication portion mounting portion penetrates through the through window portion and is protruded toward the carriage side.

Moreover, the carriage side communication device is formed in the portion corresponding to the through window portion of the carriage part for moving in the vicinity of the through window portion.

Accordingly, the supply unit communication portion of the liquid supply unit and the carriage side communication device are close to each other. Therefore, a mutual information transfer can be reliably carried out with higher precision.

Thus, it is possible to provide a liquid ejection apparatus capable of transmitting information from the liquid supply unit to the liquid ejection apparatus body in non-contact with high precision without increasing a cost.

Preferably, the liquid ejection apparatus is characterized in that a plurality of supply unit housing portions for accommodating a plurality of liquid supply units are arrayed in the supply unit arranging part in a moving direction of the carriage part, and the through window portion is formed on the carriage side of each of the supply unit housing portions.

According to the structure, a plurality of supply unit housing portions for accommodating a plurality of liquid supply units are arrayed in the supply unit arranging part in the moving direction of the carriage part, and the through window portion is formed on the carriage side of each of the supply unit housing portions.

Consequently, the carriage part is moved so that the information can be transferred in non-contact with high precision between the carriage side communication device and the supply unit communication portion accommodated in each of the supply unit housing portions.

Accordingly, it is not necessary to provide a plurality of communication devices corresponding to each liquid supply unit. Thus, it is possible to transfer information between the single carriage side communication device and the communication portion of each of the liquid supply units.

Consequently, it is possible to obtain a liquid ejection apparatus capable of more reducing a cost.

Preferably, the liquid ejection apparatus is characterized in that the through window portion formed in the supply unit housing portion is provided with a shutter portion to be brought into an opening state when the liquid supply unit is arranged in the supply unit housing portion, and a shutter side communication device is provided in the shutter portion.

According to the structure, the through window portion formed in the supply unit housing portion is provided with the shutter portion to be brought into the opening state when the liquid supply unit is arranged in the supply unit housing portion, and the shutter side communication device is provided in the shutter portion.

For this reason, if the liquid supply unit is not provided in one supply unit housing portion, the shutter portion is closed and the through window portion is brought into a closing state in the shutter portion.

Consequently, the carriage side communication device of the carriage part moving to the vicinity of the through window portion can receive information of "no liquid supply unit" from the shutter portion communication device provided in the shutter portion, for example.

Accordingly, it is possible to prevent the carriage side communication device from acquiring erroneous information.

Preferably, the liquid ejection apparatus is characterized in that a supply unit side engaging positioning portion is formed in a portion corresponding to the supply unit housing portion in the supply unit case of the liquid supply unit, a housing portion side engaging positioning portion is formed in the supply unit housing portion corresponding to the supply unit side engaging positioning portion, a mounting portion for mounting the liquid supply unit is formed in the supply unit housing portion, and a pressing member for pressing an upper surface of the liquid supply unit to be mounted on the mounting portion against the mounting surface side is formed.

According to the structure, the liquid supply unit is provided in the liquid supply portion and the supply unit side engaging positioning portion and the housing portion side engaging positioning portion are engaged with each other, and furthermore, the liquid supply unit is pressed against the mounting surface side by means of the pressing member.

Consequently, the liquid supply unit can be provided in the liquid supply housing portion more reliably.

BRIEF DESCRIPTION OF THE DRAWINGS

FIG. 21 is a schematic explanatory view showing a state in which the ink cartridge starts to press the slider in.

DETAILED DESCRIPTION OF THE PREFERRED EMBODIMENTS

Preferred embodiments of the invention will be described below in detail with reference to the accompanying drawings.

Since the following embodiments are preferred specific examples of the invention, various technically preferable restrictions are put. The scope of the invention is not restricted to these embodiments as long as it is not particularly described that the invention is limited in the following explanation.

First Embodiment

Figure 1:
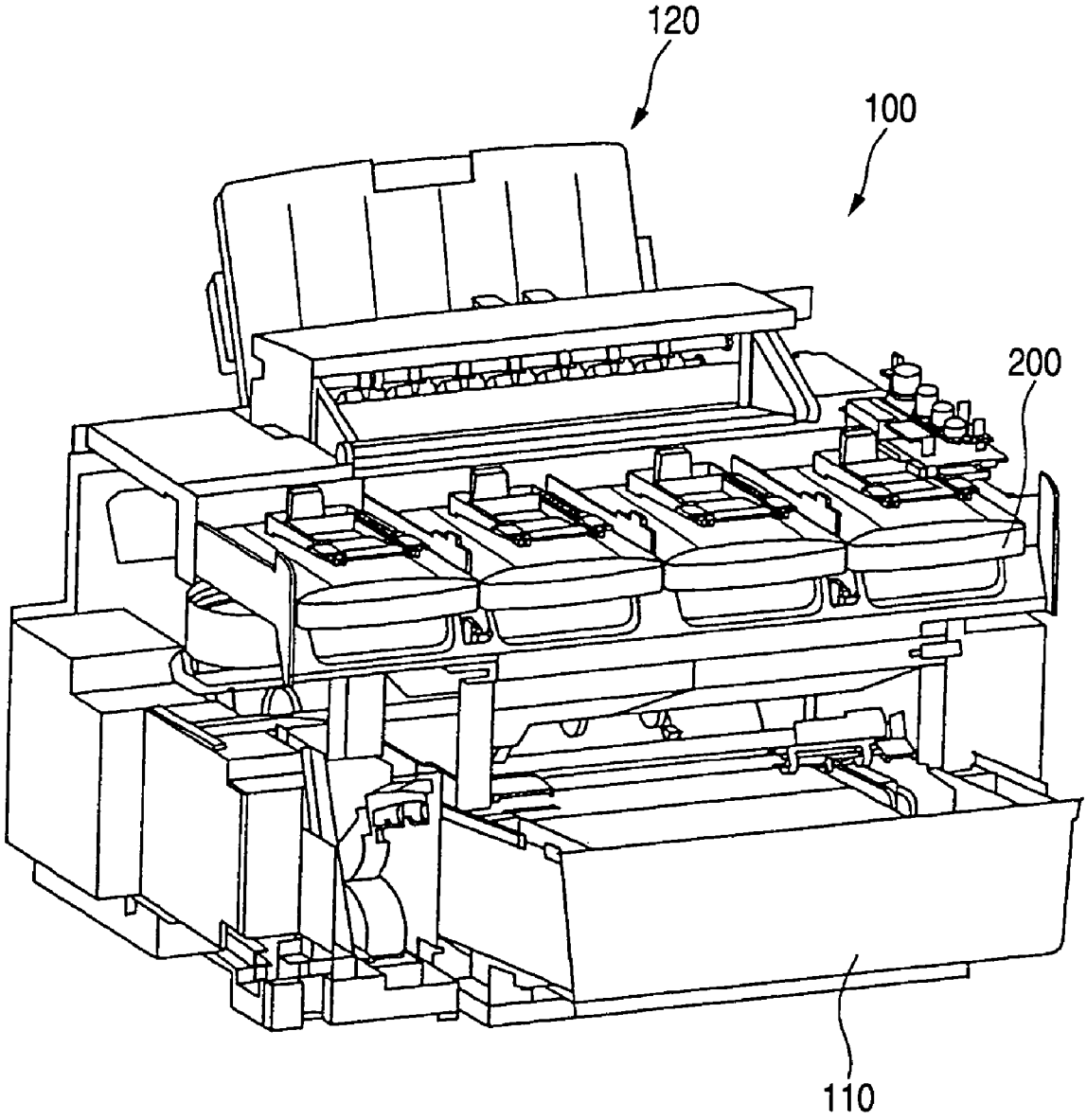
FIG. 1 is a schematic perspective view showing an ink jet type recording apparatus to be a liquid ejection apparatus according to a first embodiment of the invention, for example.

FIG. 1 is a schematic perspective view showing an ink jet type recording apparatus 100 to be a liquid ejection apparatus according to a first embodiment of the invention, for example.

As shown in FIG. 1, the ink jet type recording apparatus 100 has a recording papertray 110 for accommodating a recording paper and also has a discharging tray 120 for discharging a recording paper subjected to printing as shown in FIG. 1.

Figure 2:
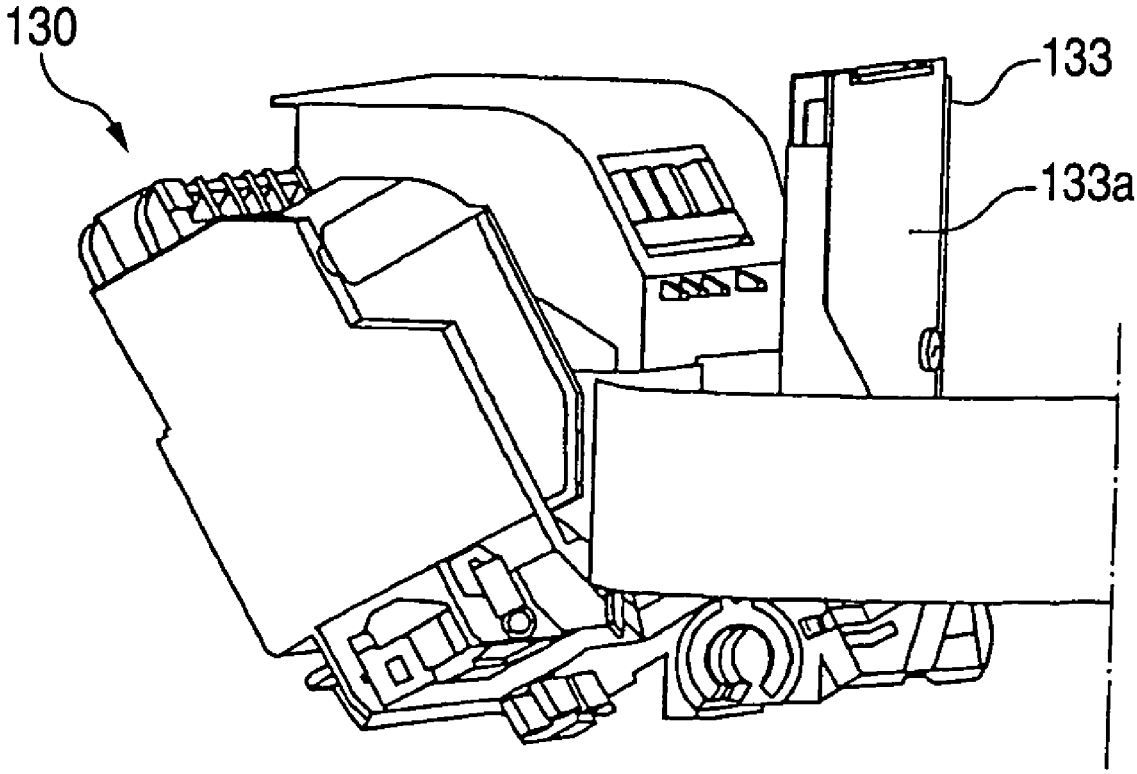
FIG. 2 is a schematic perspective view showing a carriage to be a carriage part having such a structure as to accommodate an ink jet type recording head for carrying out printing over a recording paper and to be reciprocable in a main scanning direction to be a transverse direction of the recording paper.

FIG. 2 is a schematic perspective view showing a carriage 130 to be a carriage part having such a structure as to accommodate an ink jet type recording head for thus carrying out the printing over the recording paper and to be reciprocable in a main scanning direction to be the transverse direction of the recording paper.

The carriage 130 is provided with a subtank for accommodating an ink to be a liquid to have four colors of black, yellow, magenta and cyan, for example, and an ink having each color is supplied from the subtank to the ink jet type recording head, thereby carrying out color printing.

Moreover, the ink jet type recording apparatus 100 in FIG. 1 is not used for an individual but an office or business, and has an ink storing portion in addition to the carriage 130 in order to correspond to a comparatively large amount of printing.

The ink storing portion is a liquid supply unit and an ink cartridge 200 shown in FIG. 1, for example.

In FIG. 1, four ink cartridges 200 are provided and accommodate inks of black, yellow, magenta and cyan, respectively.

The ink is supplied from the ink cartridge 200 for each color to each of the subtanks of the carriage 130 through an ink supply tube.

Even if the ink in the subtank of the carriage 130 is gone, it is properly supplied from the ink cartridge 200. Therefore, the ink jet type recording apparatus 100 can carry out a large amount of printing.

Figure 3:
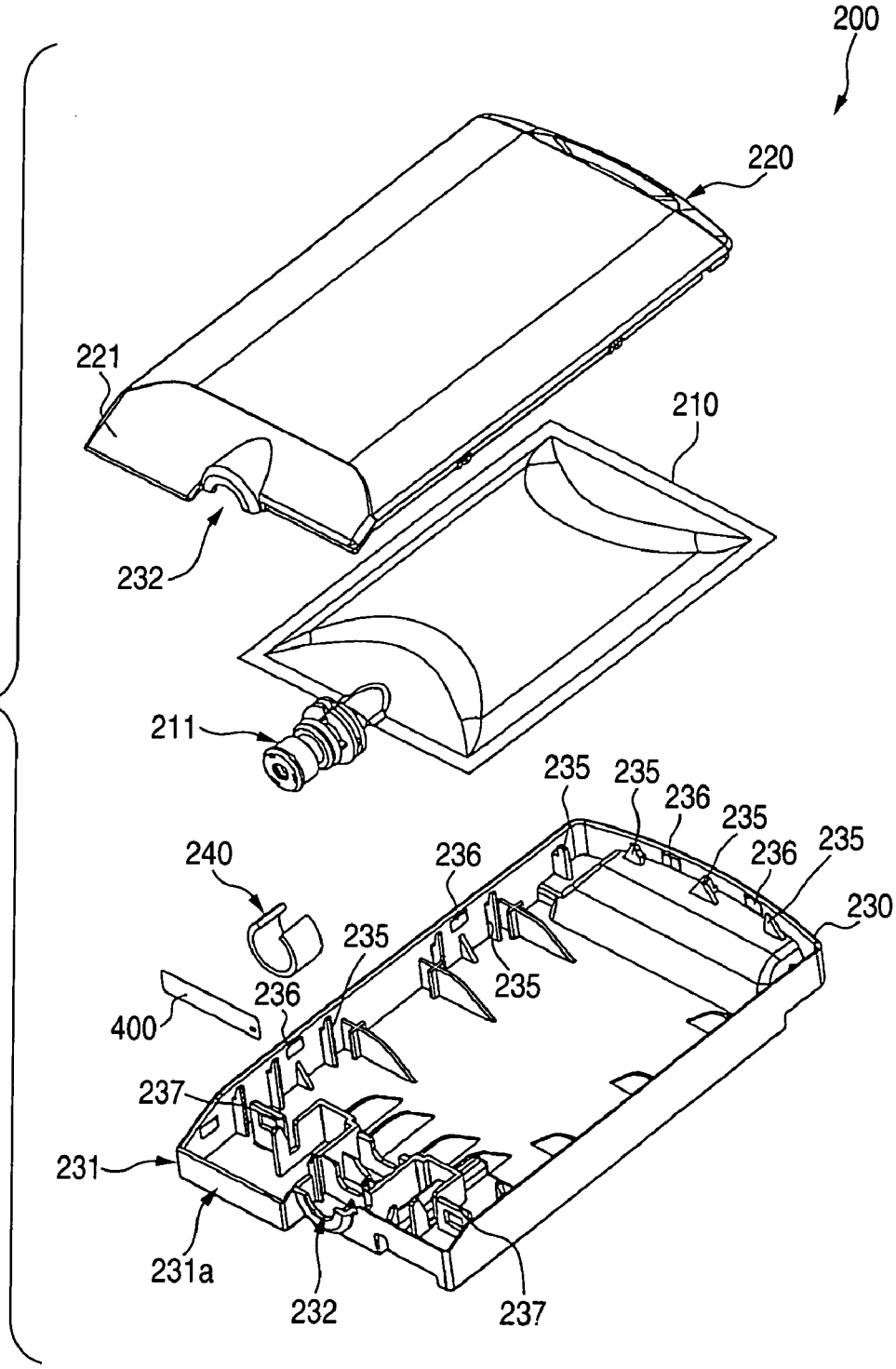
FIG. 3 is an exploded perspective view showing an ink cartridge.

FIG. 3 is an exploded perspective view showing the ink cartridge 200.

As shown in FIG. 3, there are provided an ink pack 210 to be a liquid charging portion for charging an ink, for example, and an upper case 220 (an upper supply unit case) and a lower case 230 (a lower supply unit case) to be supply unit cases for accommodating the ink pack 210, for example.

Figure 4:
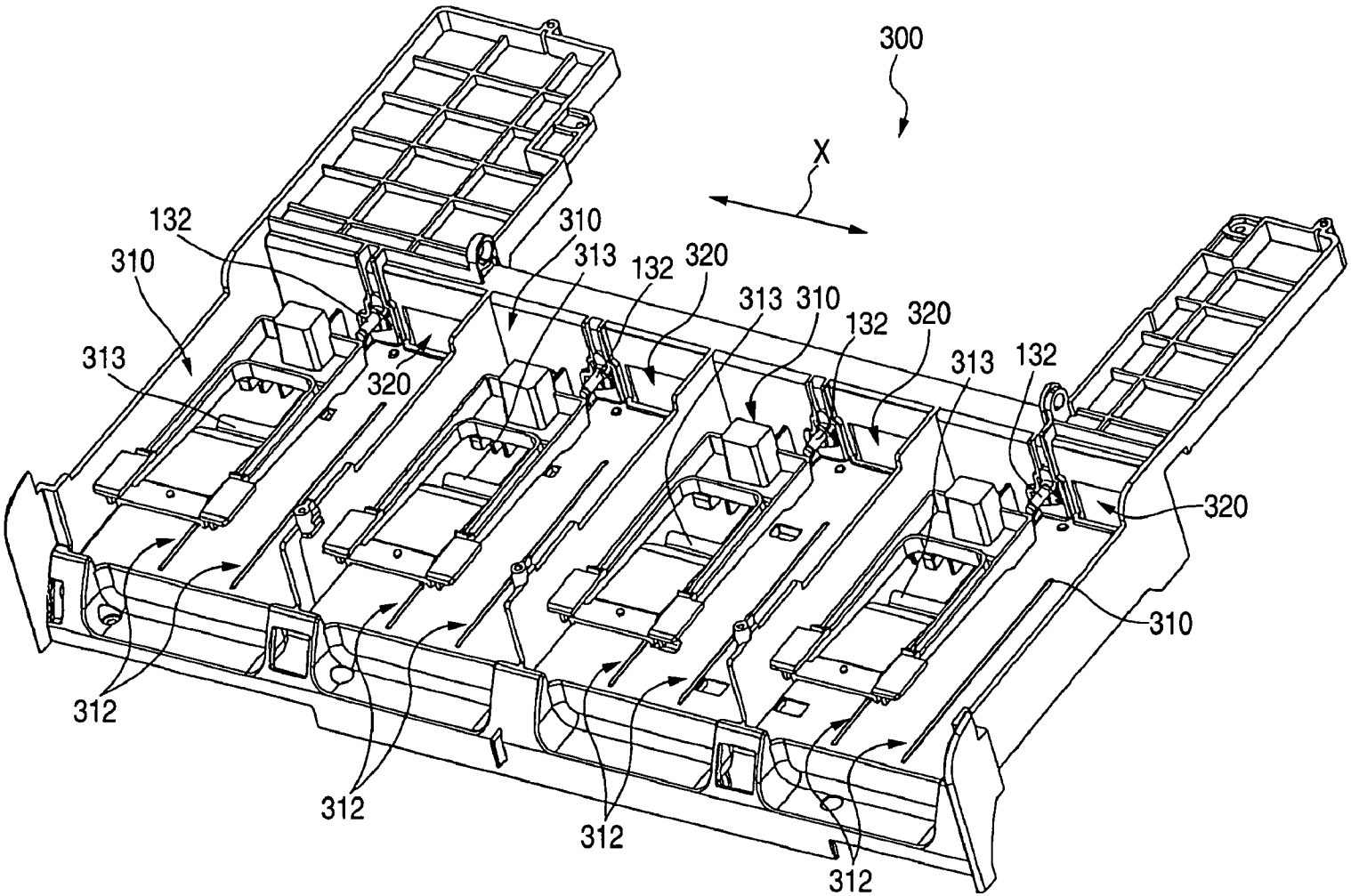
FIG. 4 is a schematic perspective view showing an ink cartridge holder to be a supply unit arranging part for arranging the ink cartridge illustrated in FIG. 3, for example.

FIG. 4 is a schematic perspective view showing an ink cartridge holder 300 to be a supply unit arranging part for arranging the ink cartridge 200 illustrated in FIG. 3, for example.

More specifically, the ink cartridge holder 300 is provided with four cartridge arranging portions 310 to be supply unit housing portions for accommodating a plurality of, for example, four ink cartridges 200.

Moreover, the cartridge arranging portion 310 is formed horizontally in the direction of the movement of the carriage 130 (the direction of an arrow X in FIG. 4).

Figure 5:
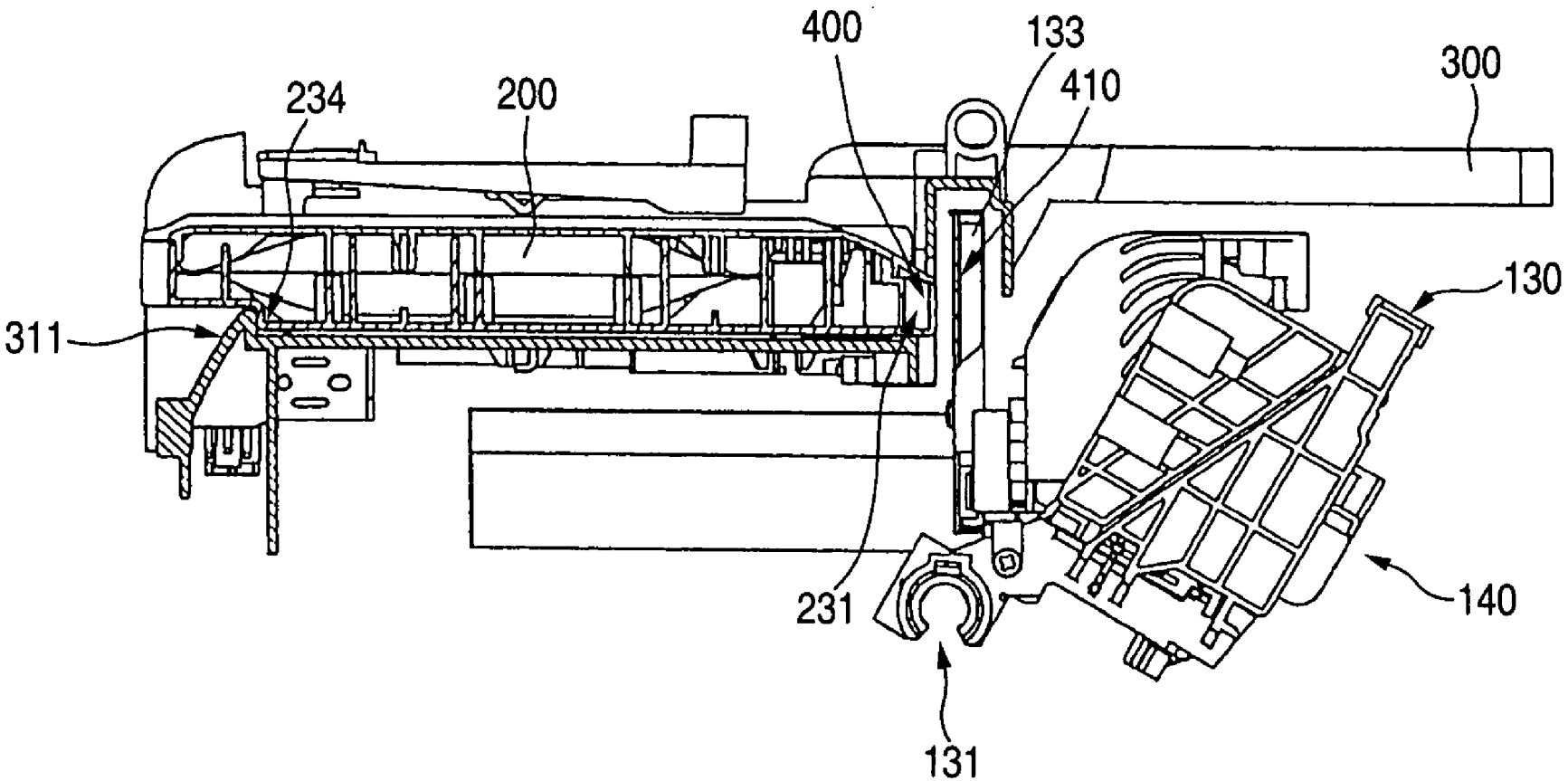
FIG. 5 is a schematic explanatory view showing a relationship with the carriage in a state in which the ink cartridge is provided in the ink cartridge holder of FIG. 4.

FIG. 5 is a schematic explanatory view showing a relationship with the carriage 130 in a state in which the ink cartridge 200 is provided in the ink cartridge holder 300 in FIG. 4.

As shown in FIG. 5, the carriage 130 accommodates an ink jet type recording head 140 and is moved in a perpendicular direction to the paper so that it is moved along the vicinity of the ink cartridge holder 300 in the direction of the arrow X in FIG. 4.

Thus, the ink jet recording apparatus 100 comprises the ink cartridge 200, and ink jet recording apparatus bodies such as the ink cartridge holder 300 and the carriage 130 to be the main body.

A supply unit communication portion mounting portion protruded toward the carriage side 130, for example, a communicating convex portion 231 is formed on the carriage 130 side of FIG. 5 in the ink cartridge 200 provided on the ink cartridge holder 300.

More specifically, an opening portion for a liquid, for example, an ink pack opening 211 is formed on the ink pack 210 as shown in FIG. 3. The ink pack opening 211 is connected to an ink leading needle 132 to be a leading needle portion provided in the ink cartridge holder 300 of FIG. 4, for example, and an ink in the ink pack 210 is led to a subtank in the carriage 130 through the ink pack opening 211, the ink leading needle 132 and the ink supply tube.

In the ink pack opening 211, therefore, there is a possibility that the ink might leak in a connection to the ink leading needle 132. Consequently, an ink absorber 240 is provided as shown in FIG. 3.

As shown in FIG. 3, moreover, a case opening 232 to be a case side opening portion is formed in a part in which the ink pack opening 211 is to be provided.

The ink pack opening 211 of the ink pack 210 is provided on the case opening 232. Consequently, the ink pack opening 211 can be connected to the ink leading needle 132 in FIG. 4.

As shown in FIG. 3, furthermore, a communicating convex portion 231 to be protruded is provided on the level with the surface of the lower case 230 on which the case opening 232 is formed, and an IC label 400 to be the supply unit communication portion, for example, is provided on the inside of a tip surface 231*a* of the communicating convex portion 231.

The IC label is obtained by embedding an IC (Integrated Circuit) or an antenna in a tape, and stores data on the type of an ink, the amount of the residual ink, a serial number and an expiration date of the ink cartridge 200 which is stuck. If at least the antenna portion of the IC label 400 is formed in the communicating convex portion 231, a communication can be carried out.

On the other hand, a through window portion 320 is formed on the carriage 130 side of the cartridge arranging portion 310 of the ink cartrige holder 300 as shown in FIG. 4, and the communicating convex portion 231 in FIG. 3 is inserted in the through window portion 320.

Moreover, the carriage 130 is provided with a plate portion 133 as shown in FIGS. 2 and 5, and the plate portion 133 is provided close corresponding to the through window portion 320 of the ink cartridge holder 300 as shown in FIG. 5.

As shown in FIG. 5, an antenna board 410 to be a carriage side communication device, for example, is provided on the back side of a plate surface 133*a* of the plate portion 133 (see FIG. 2).

Accordingly, a distance between the antenna of the IC label 400 and the antenna of the antenna board 410 shown in FIG. 5 is approximately 3 mm to 10 mm. when the antenna board 410 approaches the ink cartridge 200 with the movement of the carriage 130, therefore, information about the amount of the residual ink stored in the IC label is transmitted to the antenna board 410 reliably in non-contact.

Based on the information about the amount of the residual ink, the ink jet type recording apparatus 100 controls the ejection of the ink of the ink jet type recording head 140.

Thus, the ink jet type recording apparatus 100 can transmit the information of the ink cartridge 200 toward the carriage 130 side in non-contact with high precision without providing a large number of connecting terminals, that is, increasing a cost.

As shown in FIG. 4, moreover, the cartridge arranging portion 310 is formed horizontally in the direction of the movement of the carriage 130, and the through window portion 320 is also formed on the carriage 130 side.

Consequently, it is possible to easily set the distance between the antenna board 410 and the IC label 400 to be a communicatable distance by the movement of the carriage 130 in the direction of the arrow X.

Accordingly, a plurality of antenna boards corresponding to each IC label 400 of the ink cartridge 200 do not need to be provided but the ink jet type recording apparatus 100 can transfer information with a plurality of IC labels 400 by the single antenna board 410 provided in the plate portion 133 of the carriage 130.

As compared with the case in which a connecting terminal is provided for each ink cartridge in a contact type, consequently, the cost can be considerably reduced.

Figure 6:
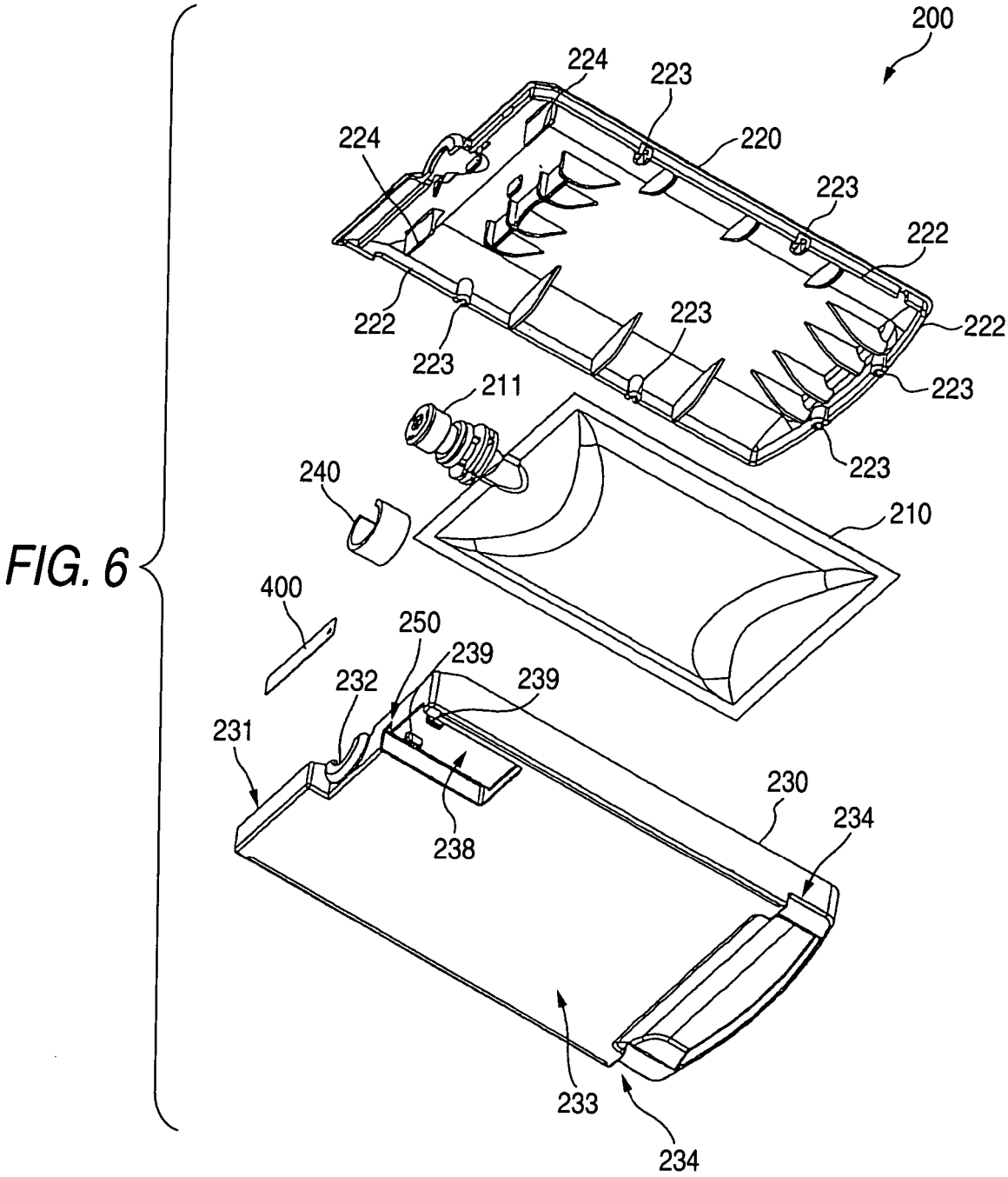
FIG. 6 is a schematic exploded perspective view showing the ink cartridge of FIG. 3 seen from below.

FIG. 6 is a schematic exploded perspective view showing the ink cartridge 200 of FIG. 3 as seen from below.

As shown in FIG. 6, a positioning concave portion 234 to be an engaging positioning portion (a supply unit side engaging positioning portion) for positioning in engagement with the cartridge arranging portion 310 is formed in a plurality of, for example, two places on a lower case bottom face 233 to be a mounting surface opposed to the cartridge arranging portion 310 in the lower case 230.

The positioning concave portion 234 is provided on the rear end side of the lower case 230 to be the opposite side of the case opening 232 of the lower case 230.

Figure 7:
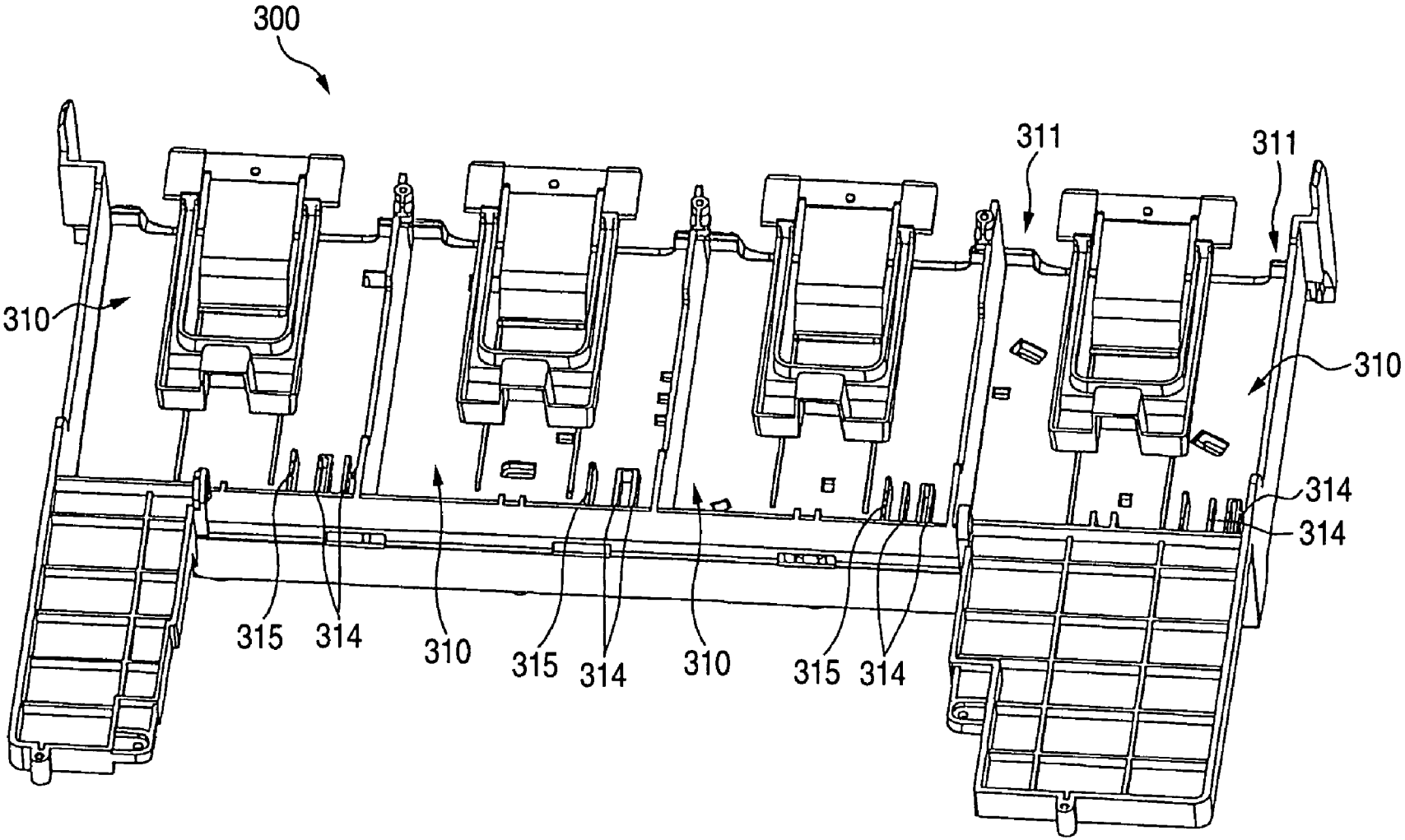
FIG. 7 is a schematic perspective view showing a state in which the direction of the ink cartridge holder in FIG. 4 is changed.

FIG. 7 is a schematic perspective view showing a state in which the direction of the ink cartridge holder 300 in FIG. 4 is changed.

As shown in FIG. 7, a cartridge support surface 311 to be a housing portion side engaging positioning portion (an engagement portion to be formed in the supply unit arranging part), for example, is formed in the cartridge arranging portion 310 corresponding to the positioning concave portions 234 in the two places.

When the ink cartridge 200 is provided in the ink cartridge holder 300, accordingly, the positioning concave portion 234 is engaged with the cartridge support surface 311 as shown in FIG. 5.

When the ink cartridge 200 is arranged in the cartridge arranging portion 310 moreover, the ink leading needle 132 of FIG. 4 sticks and is thus conected to the ink pack opening 211 of the ink cartridge 200 in FIG. 3.

Consequently, the ink cartridge 200 is positioned in the cartridge arranging portion 310 with high precision through three places in total, that is, the ink leading needle 132 and the positioning concave portions 234 in two places.

Thus, the communicating convex portion 231 of the ink cartridge 200 in FIG. 3 is also protruded accurately from the through window portion 320 in FIG. 4. Therefore, a distance between the antenna board 410 of the carriage 130 and the IC label 400 of the ink cartridge 200 can be set within a proper range. Thus, a communication can always be carried out with high precision.

Moreover, the positioning concave portion 234 is engaged with the cartridge support surface 311. Therefore, the positioning can easily be carried out by a simple structure so that a positioning mechanism requiring a low cost is obtained.

The communicating convex portion 231 of the ink cartridge 200 in FIG. 3 is formed in the vicinity of the case opening 232 of the lower case 230.

For this reason, the communicating convex portion 231 is provided in the vicinity of the ink leading needle 132 to be the positioning means. Consequently, the communicating convex portion 231 can be positioned with higher precision.

Accordingly, the distance between the antenna board 410 of the carriage 130 and the IC label 400 can be held more accurately. Thus, the communication can be carried out with much higher precision.

As shown in FIG. 6, moreover, the case of the ink cartridge.200 is divided into the upper case 220 and the lower case 230, and the ink pack 210 can easily be accommodated in the case.

A part of the case opening 232, the positioning concave portions 234 and 234 in two places and the communicating convex portion 231 are formed on the lower case 230.

Consequently, portions to play a part in the positioning are completely arranged in the lower case 230. Therefore, the lower case 230 can be positioned with higher precision than the upper case 220.

By the formation of the communicating convex portion 231 in the lower case 230, the IC label 400 to be provided on the communicating convex portion 231 can be positioned with much higher precision, and the distance from the antenna board 410 of the carriage 130 can be held more accurately so that precision in a communication can be enhanced.

Figure 8A:
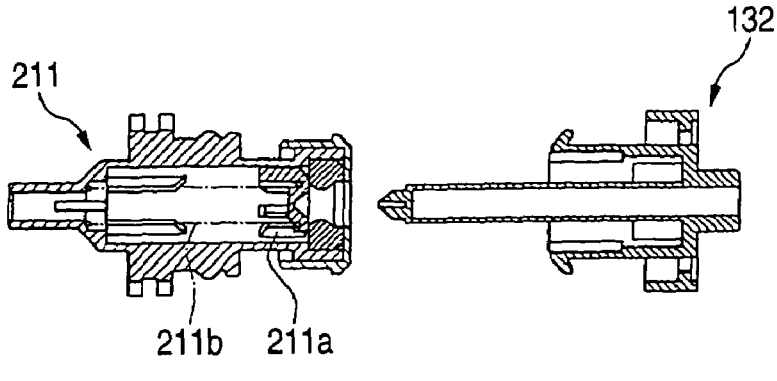
FIG. 8A is a schematic sectional view showing the relationship between an ink leading needle in FIG. 4 and an ink pack opening in FIG. 3.
Figure 8B:
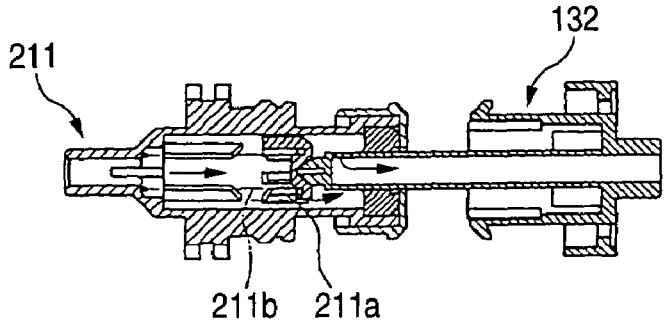
FIG. 8B is a schematic sectional view showing a state in which the ink leading needle is inserted in the inc pack opening.

FIG. 8A is a schematic sectional view showing the relationship between the ink leading needle 132 in FIG. 4 and the ink pack opening 211 in FIG. 3. FIG. 8B is a schematic sectional view showing a state in which the ink leading needle 132 is inserted in the ink pack opening 211.

As shown in FIG. 8A, a plug member 211*a* to be a liquid plug portion of the ink leading needle 132 which is movable in a longitudinal direction is formed on the ink pack opening 211, and the plug member 211*a* has a spring 211*b* to be energizing means for bringing the ink pack opening 211 into a closing state, for example.

More specifically, the plug member 211*a* is pressed in a rightward direction by the force of the spring 211*b* as shown in FIG. 8A and the ink pack opening 211 is brought into the closing state.

As shown in FIG. 8B, the tip portion of the ink leading needle 132 abuts on the plug member 211*a*. When the tip portion of the ink leading needle 132 is pressed in a leftward direction in FIG. 8B, the plug member 211*a* is also moved in the leftward direction so that the ink pack opening 211 is brought into an opening state as shown in FIG. 8B.

Accordingly, the ink pack opening 211 is brought into the closing state by the energizing force of the spring in the transportation of the ink cartridge 200 so that an internal ink does not leak.

Moreover, the ink cartridge 200 is provided in the cartridge arranging portion 310 and the positioning concave portion 234 of the lower case 230 is engaged with the cartridge support surface 311 of the cartridge arranging portion 310, and the ink leading needle 132 is inserted into the ink pack opening 211. Consequently, the ink can easily be supplied to the ink leading needle 132 side.

When the plug member 211*a* is pressed toward the left side by the ink leading needle 132, such force as to move the whole ink cartridge 200 in the leftward direction of FIG. 5 is applied by the force of the spring 211*b*.

As shown in FIG. 5, however, the positioning concave portion 234 of the ink cartridge 200 abuts on the cartridge support surface 311 of the cartridge arranging portion 310.

Consequently, the ink cartridge 200 can be prevented from being moved toward the left side, and furthermore, accurate positioning can be carried out.

In the case in which the ink pack opening 211 is brought into the opening state, moreover, the energizing force of the spring 211*b* is transmitted to the lower case 230 so that the positioning concave portion 234 and the cartridge support surface 311 are reliably engaged.

As shown in FIG. 4, a mounting surface 312 for directly mounting the ink cartridge 200 is formed in the cartridge arranging portion 310, and there is provided a pressing member for pressing the upper surface of the ink cartridge 200 mounted on the mounting surface 312 against the mounting surface 312 side, for example, a pressing spring 313.

Figure 9:
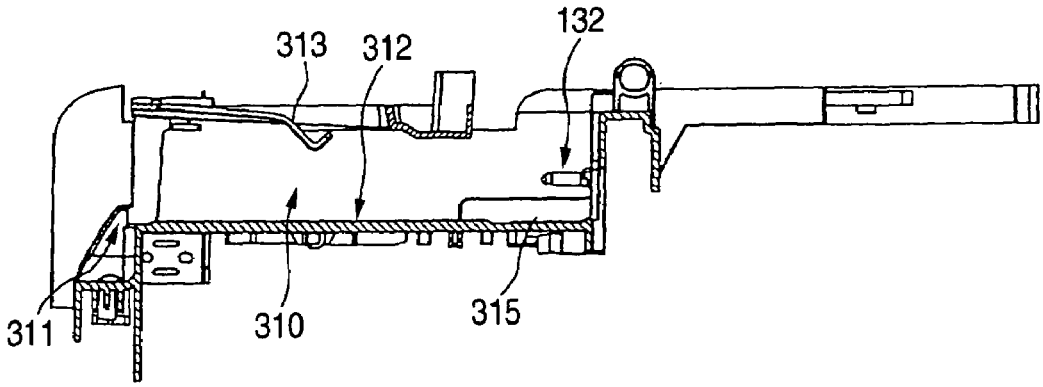
FIG. 9 is a schematic sectional view showing a cartridge arranging portion.

FIG. 9 is a schematic sectional view showing the cartridge arranging portion 310. As shown in FIG. 9, the pressing spring 313 is arranged to be energized toward the mounting surface 312 side to be a lower side.

The ink cartridge 200 is provided in the cartridge arranging portion 310 of FIG. 9, and the positioning concave portion 234 on the rear end of the ink cartridge 200 is engaged with the cartridge support surface 311 to insert the ink leading needle 132 into the ink pack opening 211.

When the ink cartridge 200 is pressed against the mounting surface 312 side from above by means of the pressing spring 313, furthermore, the ink cartridge 200 is positioned in four places in total including the ink leading needle 132, the cartridge support surface 311 in two places and the pressing spring 313. Consequently, the positioning can be carried out with higher precision.

Moreover, a surface 221 inclined toward an outer edge is formed on the case opening 232 side of the upper case 220 in the ink cartridge 200 as shown in FIG. 3.

The inclined surface 221 is an example of an inclined portion for guide which serves to guide the pressing spring 313 in FIG. 9 to the upper surface of the upper case 220.

More specifically, when the ink cartridge 200 in FIG. 3 is inserted from the left side of the cartridge arranging portion 310 in FIG. 9, the inclined surface 221 of the upper case 220 abuts on the tip portion of the pressing spring 313 to guide the tip portion of the pressing spring 313.

The tip portion of the guided pressing spring 313 is provided on the upper surface of the upper case 220 with the insertion of the ink cartridge 200.

Figure 10:
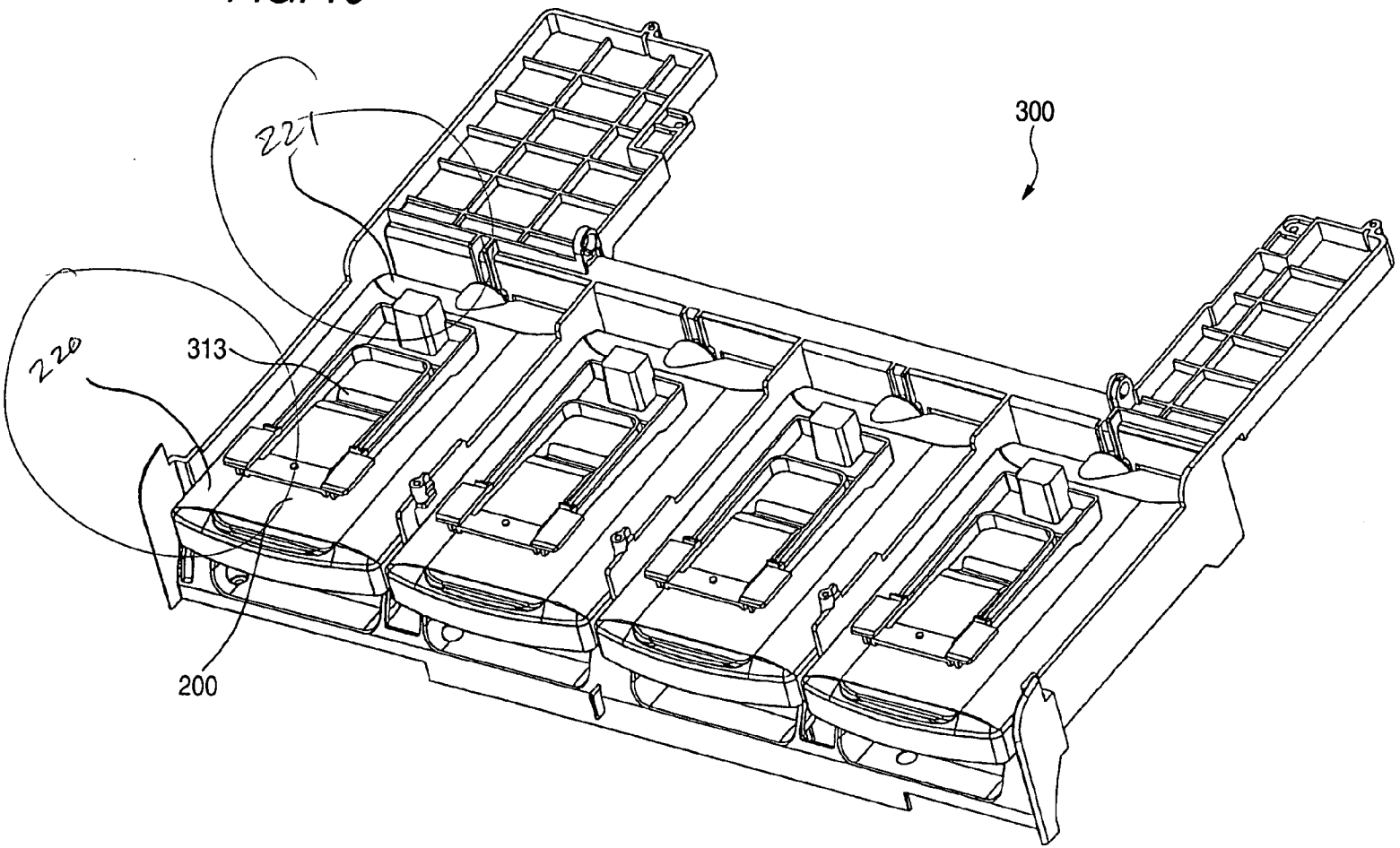
FIG. 10 is a schematic perspective view showing a state in which the ink cartridge is provided in the cartridge arranging portion.

FIG. 10 is a schematic perspective view showing a state in which the ink cartridge 200 is provided in the cartridge arranging portion 310.

As shown in FIG. 10, the pressing spring 313 is provided on the upper surface of the upper case 220 in the ink cartridge 200 and functions to carry out pressing against the mounting surface 312 (FIG. 4) side.

Thus, the inclined surface 221 is formed on the upper case 220. In the insertion of the ink cartridge 200, therefore, the ink cartridge 200 can be smoothly arranged in the cartridge arranging portion 310 without disturbing the insertion by means of the pressing spring 313.

As shown in FIG. 6, an upper case convex portion 222 to be an upper convex portion is formed in three places on the outer periphery of the upper case 220, for example, a long side and a short side of the rear end.

On the other hand, as shown in FIG. 3, the lower case 230 is provided with 15 lower concave portions corresponding to the upper case convex portions 222, for example, lower case concave portions 235 in total.

The upper case convex portion 222 is mated with the lower case concave portion 235.

Figure 11:
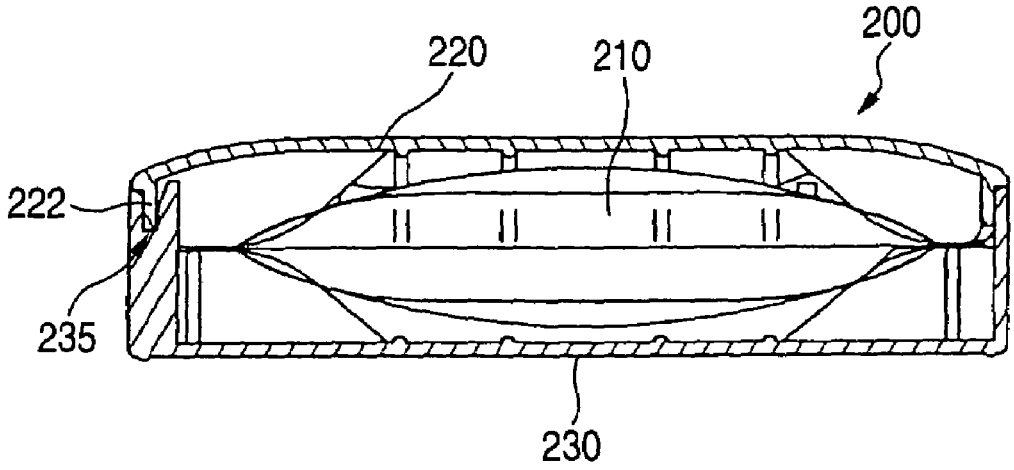
FIG. 11 is a schematic sectional view showing a state in which an upper case convex portion is mated with a lower case concave portion.

FIG. 11 is a schematic sectional view showing a state in which the upper case convex portion 222 is mated with the lower case concave portion 235.

As shown in FIG. 11, the upper case convex portion 222 is accommodated in the groove of the lower case concave portion 235 without generating a large clearance.

As shown in FIG. 6, moreover, engaging convex portions 223 to be engaging convex portions are formed in six places on the outer periphery of the upper case 220, for example.

Corresponding to the engaging convex portion 223, as shown in FIG. 3, an engaging concave portion 236 to be an engaging concave portion is formed in six places on the outer periphery of the lower case 230, for example.

Figure 12:
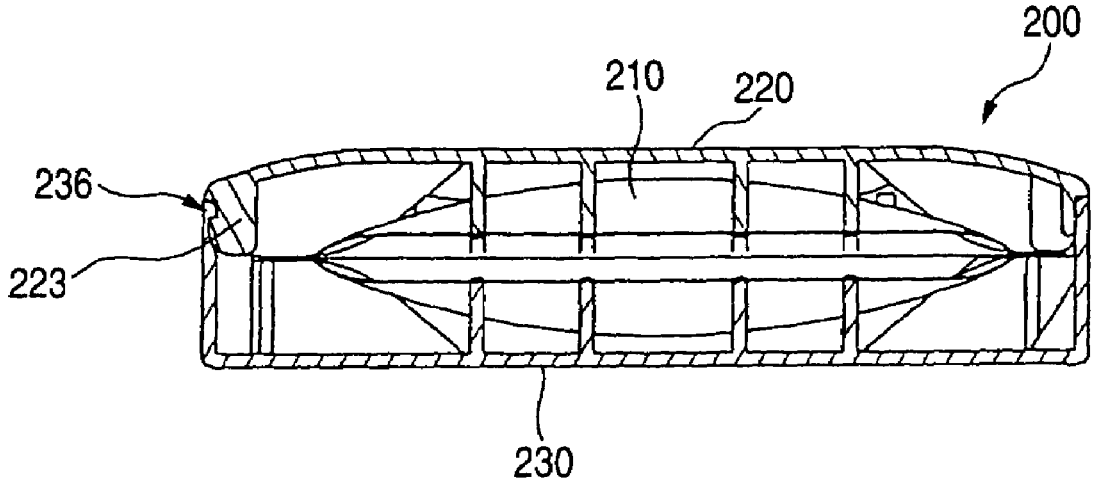
FIG. 12 is a schematic sectional view showing a state in which the engaging convex portion of an upper case is engaged with the engaging concave portion of a lower case.

FIG. 12 is a schematic sectional view showing a state in which the engaging convex portion 223 of the upper case 220 is engaged with the engaging concave portion 236 of the lower case 230.

As shown in FIG. 12, the engaging convex portion 223 is engaged to be caught in the engaging concave portion 236 and the upper case 220 and the lower case 230 can be prevented from being easily separated.

In the upper case 220 and the lower case 230, thus, the upper case convex portion 222 and the lower case concave portion 235 are mated with each other on the outer peripheries thereof. In the mating state, furthermore, the engaging convex portion 223 of the upper case 220 is engaged with the engaging concave portion 236 of the lower case 230.

Accordingly, the upper case 220 and the lower case 230 are firmly coupled to each other.

As shown in FIG. 6, moreover, an internal engaging projection piece, for example, an engaging projection piece 224 is formed in two places in a separated position from the outer periphery of the upper case 220 in an inward direction.

As shown in FIG. 3, an engaged portion 237 corresponding to the engaging projection piece 224 is provided in the lower case 230.

The engaged portion 237 has such a structure that a through hole is formed in a central part and the tip portion of the engaging projection piece 224 is engaged with the through hole.

Figure 13:
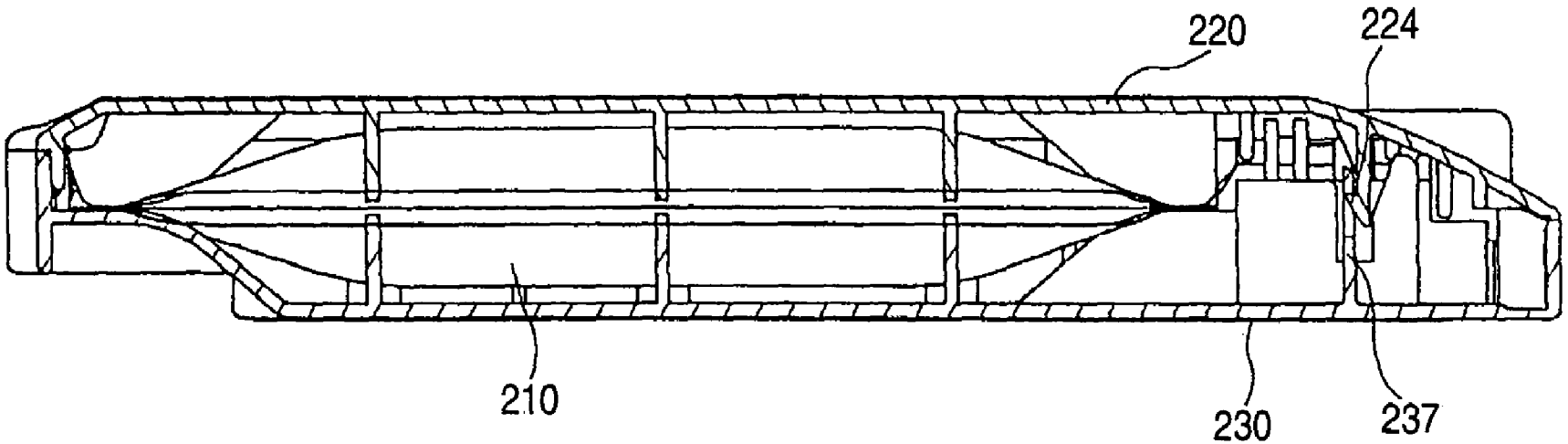
FIG. 13 is a schematic sectional view showing a state in which the engaging projection piece of the upper case is engaged with the engaged portion of the lower case.

FIG. 13 is a schematic sectional view showing a state in which the engaging projection piece 224 of the upper case 220 is engaged with the engaged portion 237 of the lower case 230.

As shown in FIG. 13, the engaging projection piece 224 is firmly engaged with the through hole of the engaged portion 237.

Thus, the engaging projection piece 224 and the engaged portion 237 are formed in separated positions from the outer peripheries of the upper case 220 and the lower case 230, that is, separated positions from a boundary part of the upper case 220 and the lower case 230.

In the case in which the ink cartridge 200 is dropped during the transportation of the ink cartridge 200 to give a shock, there is a possibility that the upper case 220 and the lower case 230 might be deformed and the engaging convex portion 223 and the engaging concave portion 236 provided in the outer peripheral portion to be the boundary part of the upper case 220 and the lower case 230 might be disengaged from each other and be thus disconnected from each other.

In the embodiment, however, the engaging projection piece 224 and the engaged portion 237 are provided in the separated positions from the outer peripheries of the upper case 220 and the lower case 230. Therefore, the influence of the deformation of the upper case 220 and the lower case 230 is small so that both of them can be prevented from being easily disengaged and released from each other.

Consequently, it is possible to obtain the ink cartridge 200 having a high reliability in which the case can be prevented from being easily disconnected even if a shock such as dropping is given.

Thus, it is possible to prevent the generation of such a defect that the ink cartridge 200 cannot be attached to the ink jet type recording apparatus 100 and data of an IC cannot be transferred.

As shown in FIG. 6, a concave portion 238 for a rib is formed, on the lower surface of the lower case 230, as a concave portion taking the shape of an almost rectangular parallelepiped in the form of a concave.

A plurality of erroneous arrangement preventing ribs 239 (supply unit side erroneous arrangement preventing ribs) are formed to be protruded from the bottom face of the concave portion 238 for a rib.

A plurality of erroneous arrangement preventing ribs 239 fulfill one discriminating function.

On the other hand, as shown in FIG. 7, a housing portion side erroneous arrangement preventing rib, for example, an erroneous arrangement preventing rib 314 is also formed in each of four cartridge arranging portions 310. The erroneous arrangement preventing ribs 314 have different shapes from each other.

If the shape of the erroneous arrangement preventing rib 239 of the ink cartridge 200 corresponds to that of the erroneous arrangement preventing rib 314 of the cartridge arranging portion 310, therefore, the ink cartridge 200 can be correctly provided without abutting on the erroneous arrangement preventing rib 314 of the cartridge arranging portion 310.

If the shapes do not correspond to each other, however, the ink cartridge 200 is hindered by the erroneous arrangement preventing rib 314 of the cartridge arranging portion 310 and cannot be correctly arranged.

More specifically, the ink cartridge 200 accommodates any of the four colors including black, yellow, magenta and cyan as described above, and places in which the ink cartridges 200 having these colors are to be provided are specified.

Accordingly, the erroneous arrangement preventing rib 314 is formed in the cartridge arranging portion 310 of FIG. 7 in such a manner that the ink cartridge 200 other than the ink cartridge 200 having the color cannot be inserted therein. The ink cartridge 200 is also constituted to accommodate an ink having a specific color. In order to discriminate the color, therefore, the erroneous arrangement preventing rib 239 corresponding to the erroneous arrangement preventing rib 314 of the cartridge arranging portion 310 is formed.

When a user is thus arranging the ink cartridge 200 having a black ink in the cartridge arranging portion 310 for a yellow color by mistake, for example, the ink cartridge 200 cannot be arranged in abutment on the erroneous arrangement preventing rib 239 of the cartridge arranging portion 310 and the user can immediately recognize the mistake. Accordingly, it is possible to prevent the erroneous arrangement of the ink cartridge 200 having a different color.

Since the erroneous arrangement preventing rib 239 of the ink cartridge 200 is formed in the concave portion 238 for a rib as shown in FIG. 6, moreover, a tip portion thereof can be prevented from being protruded from the surface of the lower case 230.

When the ink cartridge 200 is to be packed and delivered, therefore, there is no possibility that the erroneous arrangement preventing rib 239 might break the package. Thus, it is possible to prevent a deterioration in the value of goods.

As shown in FIG. 6, moreover, a direction error preventing groove, for example, a reverse insertion preventing groove 250 is formed in the concave portion 238 for a rib of the lower case 230 in the ink cartridge 200, for example.

As shown in FIGS. 7 and 9, furthermore, a direction error preventing rib corresponding to the reverse insertion preventing groove 250, for example, a reverse insertion preventing rib 315 is formed in the cartridge arranging portion 310.

Accordingly, if both sides of the ink cartridge 200 are arranged by mistake or a tip portion and a rear end are arranged reversely, the reverse insertion preventing rib 315 of the cartridge arranging portion 310 cannot correspond to the reverse insertion preventing groove 250 of the lower case 230 so that the ink cartridge 200 abuts on the reverse insertion preventing rib 315 and cannot be arranged correctly.

Figure 14:
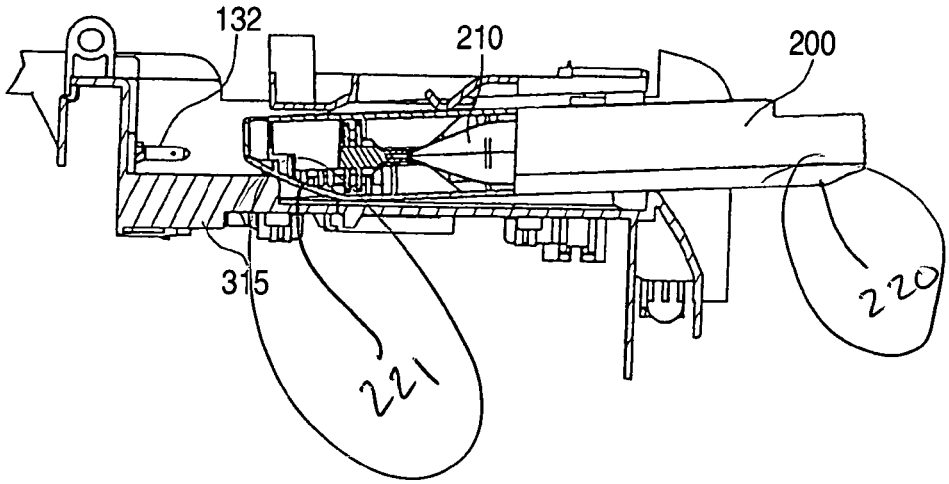
FIG. 14 is a schematic explanatory view showing a state in which the ink cartridge is inserted reversely at both sides.

More specifically, FIG. 14 is a schematic explanatory view showing a state in which the ink cartridge 200 is inserted reversely at both sides.

As shown in FIG. 14, the inclined surface 221 of the upper case 220 in the ink cartridge 200 abuts on the reverse insertion preventing rib 315 so that the ink cartridge 200 cannot be arranged correctly.

Moreover, the reverse insertion preventing rib 315 is stopped before a part of the ink cartridge 200 reaches the ink leading needle 132. Consequently, it is possible to prevent the ink cartridge 200 from breaking the ink leading needle 132 due to a reverse insertion.

Figure 15:
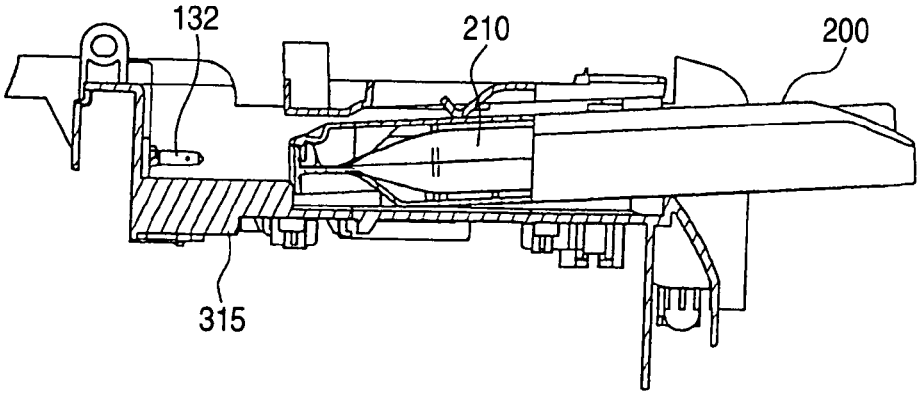
FIG. 15 is a schematic explanatory view showing an example in which the ink cartridge is inserted reversely at front and rear parts.

Moreover, FIG. 15 is a schematic explanatory view showing an example in which the ink cartridge 200 is inserted longitudinally reversely.

As shown in FIG. 15, the rear end of the ink cartridge 200 abuts on the reverse insertion preventing rib 315 and cannot be provided correctly.

Figure 16:
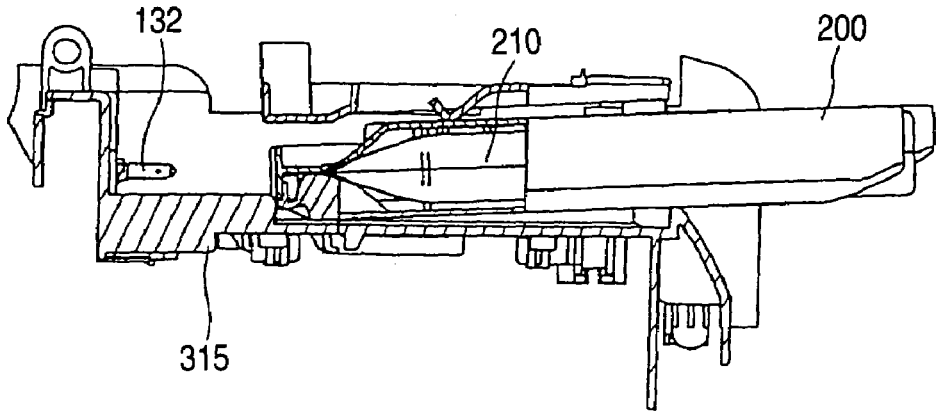
FIG. 16 is a schematic explanatory view showing the case in which the ink cartridge is arranged reversely at the both sides and the front and rear parts.

FIG. 16 is a schematic explanatory view showing the case in which both sides and the front and rear parts of the ink cartridge 200 are arranged reversely.

As shown in FIG. 16, also in this case, the ink cartridge 200 cannot be arranged correctly in the same manner as in FIGS. 14 and 15.

Accordingly, the reverse insertion can be prevented simply and reliably with such a structure that the reverse insertion preventing rib 315 and the reverse insertion preventing groove 250 are formed, and the ink leading needle 132 can also be prevented from being broken due to an erroneous insertion.

Second Embodiment

Figure 17:
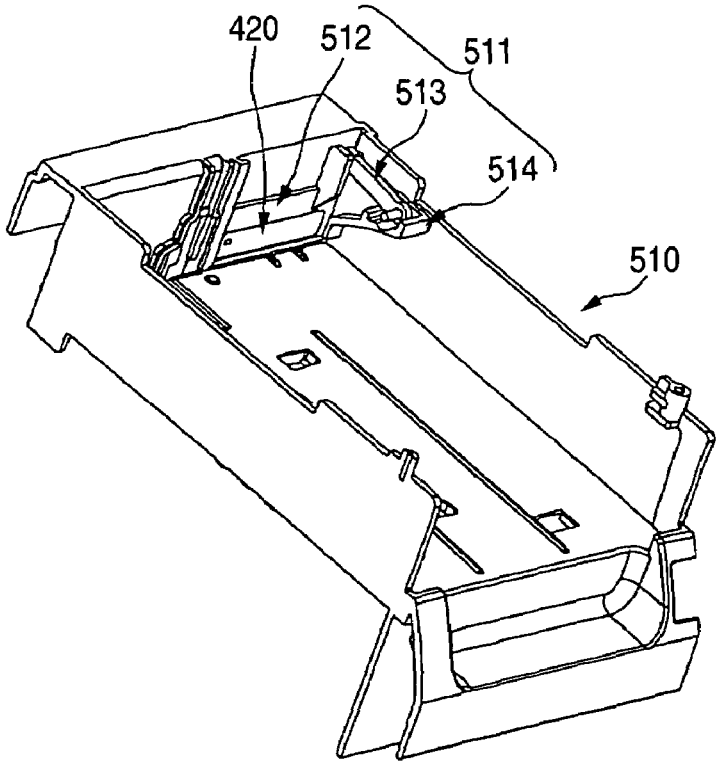
FIG. 17 is a schematic perspective view showing the main part of an ink jet type recording apparatus according to a second embodiment of the invention.
Figure 18:
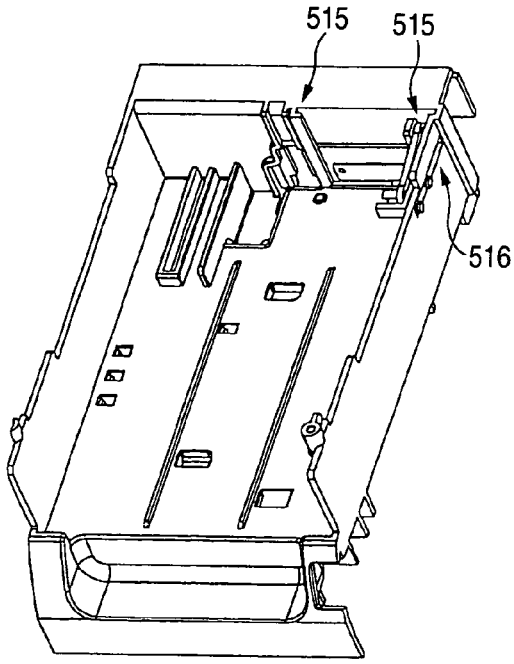
FIG. 18 is a schematic perspective view showing a different direction from that in FIG. 17.

FIG. 17 is a schematic perspective view showing the main part of an ink Jet type recording apparatus according to a second embodiment of the invention. FIG. 18 is a schematic perspective view showing a different direction from that in FIG. 17.

The structure of the ink jet type recording apparatus according to the second embodiment is mostly common to that of the ink jet type recording apparatus 100 according to the first embodiment. Therefore, the same structures have the same reference numerals and description will be omitted, and differences will be mainly described below.

FIG. 17 is a schematic perspective view showing only one cartridge arranging portion 510 in an ink cartridge holder of the ink jet type recording apparatus according to the second embodiment.

As shown in FIG. 17, a shutter portion 511 for opening and closing a through window portion 320 is formed in the through window portion 320 of the cartridge arranging portion 510.

The shutter portion 511 has a shutter plate 512 for moving in a vertical direction. Moreover, there are provided a slider 514 for abutting on an ink cartridge 200 to move horizontally when the ink cartridge 200 is inserted in the cartridge arranging portion 510, and a shaft 513 for vertically moving the shutter plate 512 by setting the motion of the slider 514 to be a motion in a vertical direction.

As shown in FIG. 18, furthermore, there are also provided a vertical guide 515 for regulating the motion of the shutter plate 512 in the vertical direction and a horizontal guide 516 for regulating the motion of the slider 514 in a horizontal direction.

As shown in FIG. 17, moreover, shutter side communication device, for example, a shutter IC label 420 is provided on the inside of the shutter plate 512.

The shutter IC label 420 stores information of "no ink cartridge" and has such a structure as to be communicatable with an antenna board 410 of a carriage 130 in non-contact.

Next, the operation of the shutter portion 511 will be described with reference to FIGS. 19 to 22.

Figure 19:
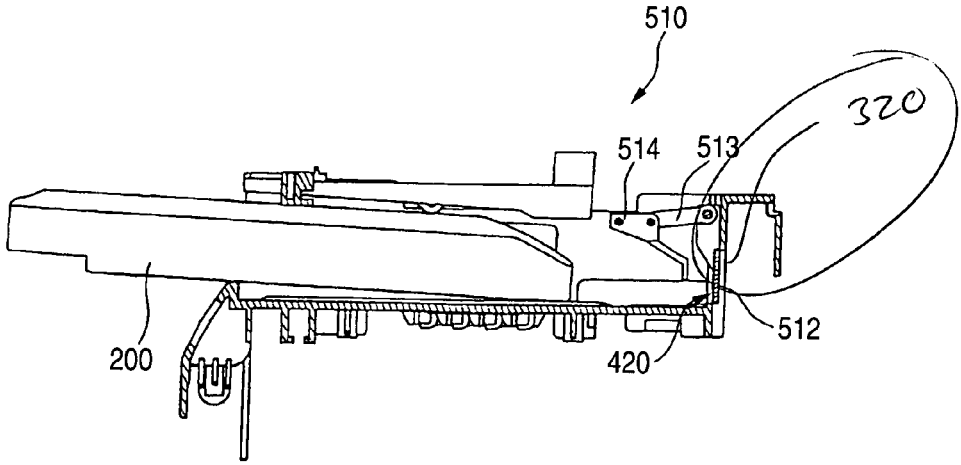
FIG. 19 is a schematic explanatory view showing a state in which an ink cartridge starts to be inserted in a cartridge arranging portion.

First of all, FIG. 19 is a schematic explanatory view showing a state in which the ink cartridge 200 starts to be inserted in the cartridge arranging portion 510.

In the state of FIG. 19, the shutter plate 512 is arranged downward to bring the through window portion 320 into a closing state.

At this time, when the carriage 130 approaches, the antenna board 410 of the carriage 130 and the shutter IC label 420 of the shutter plate 512 are provided close to each other so that a communication can be carried out.

Therefore, the antenna board 410 of the carriage 130 receives the information of "no ink cartridge" from the shutter IC label 420. Consequently, the ink jet type recording apparatus can accurately grasp the correct situation of the cartridge arranging portion 510.

Thus, a possibility that the ink jet type recording apparatus might acquire erroneous information is reduced more remarkably as compared with the case in which the shutter is not provided.

Figure 20:
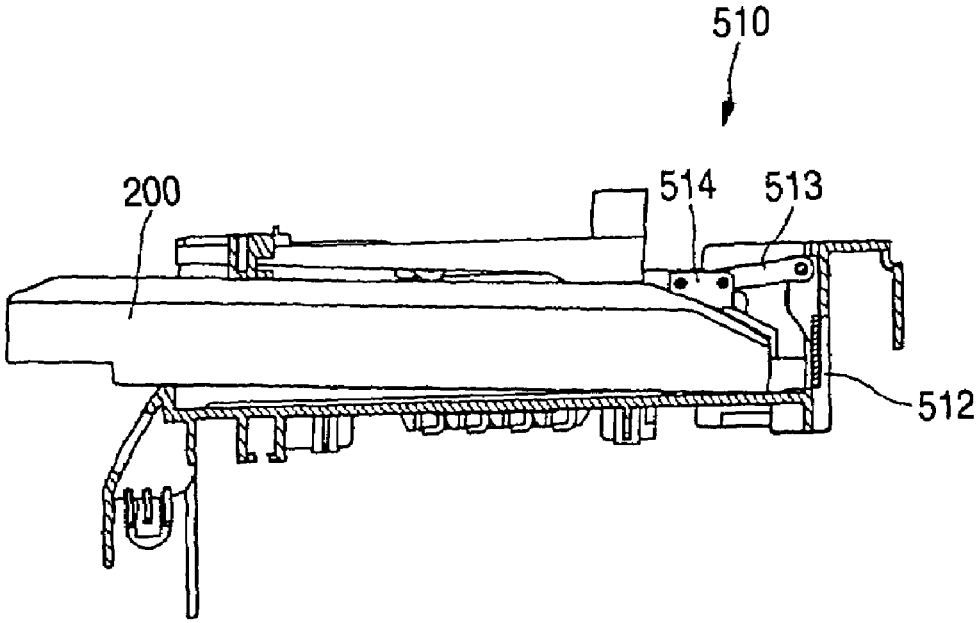
FIG. 20 is a schematic explanatory view showing a state in which the ink cartridge is further inserted and comes in contact with a slider.
Figure 21:
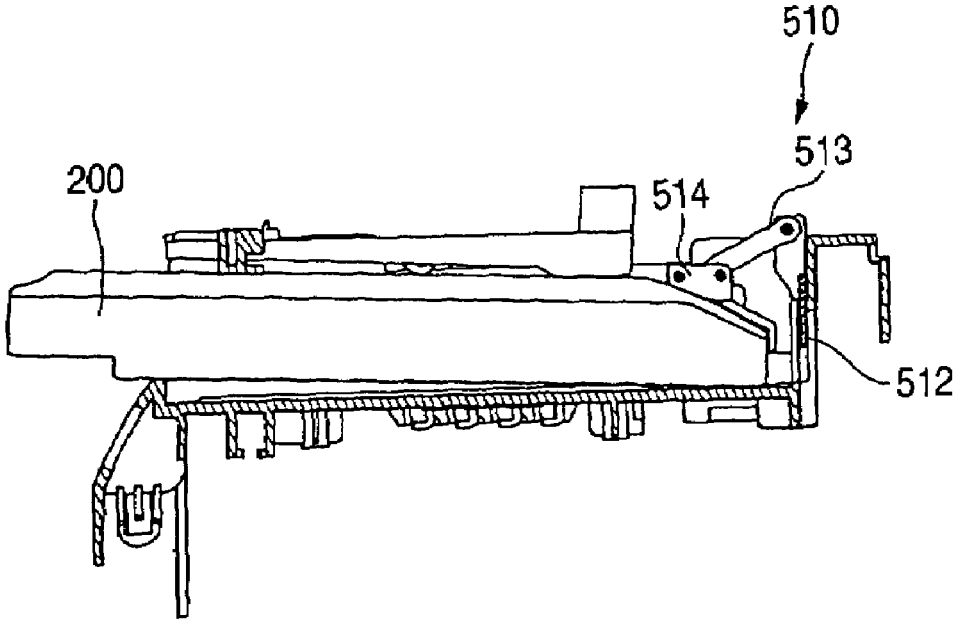

Next, FIG. 20 is a schematic explanatory view showing a state in which the ink cartridge 200 is further inserted to come in contact with the slider 514. FIG. 21 is a schematic explanatory view showing a state in which the ink cartridge 200 starts to press the slider 514 in.

As shown in FIGS. 20 and 21, when the ink cartridge 200 abuts on the slider 514 to start pressing in a horizontal direction, the slider 514 is also moved so that the shutter plate 512 is brought into a half-opening state through the shaft 513.

Figure 22:
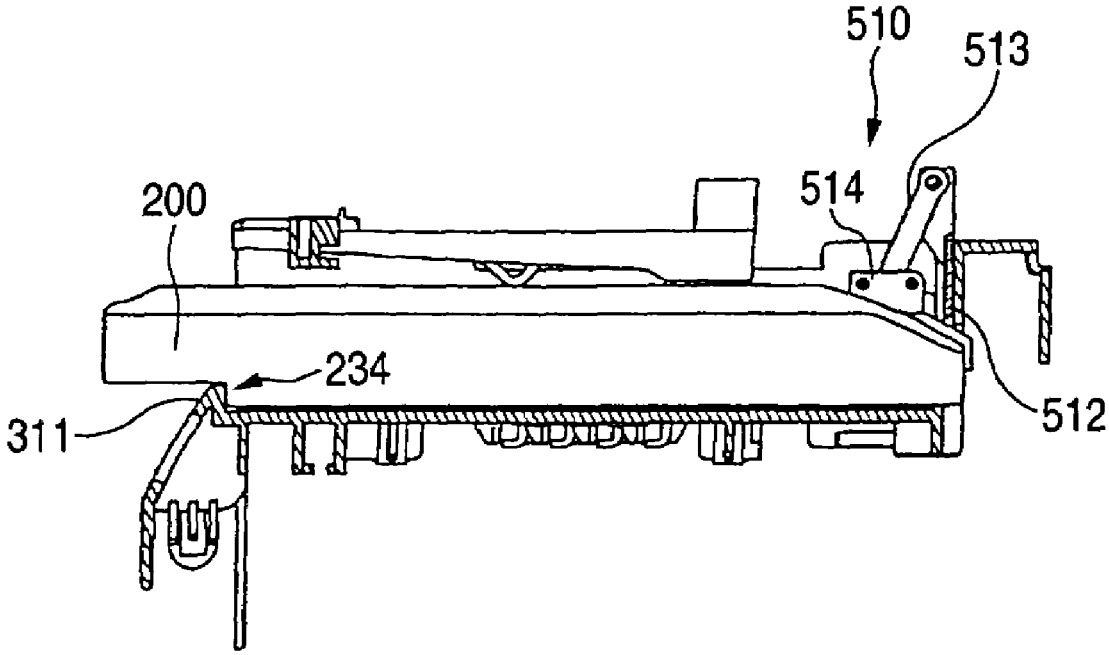
FIG. 22 is a schematic explanatory view showing a state in which the ink cartridge is further inserted and is correctly arranged.

FIG. 22 is a schematic explanatory view showing a state in which the ink cartridge 200 is further inserted and is arranged correctly.

As shown in FIG. 22, the slider 514 is further pressed and a positioning concave portion 234 of the ink cartridge 200 is engaged with a cartridge support surface 311 of the cartridge arranging portion 510. Consequently, the shutter plate 512 is moved completely upward and the through window portion 320 is brought into an opening state, and a communicating convex portion 231 of the ink cartridge 200 is inserted in the through window portion 320 so that the ink cartridge 200 is completely attached.

Since the shutter portion 511 is correspondingly opened and closed in a process for attaching the ink cartridge 200 to the cartridge arranging portion 510, thus, it does not require a user to carry out a special operation but serves as a convenient mechanism.

The invention is not restricted to the embodiments. Furthermore, each of the embodiments may be constituted in mutual combination.

What is claimed is:

1. A liquid ejection apparatus comprising:

a supply unit arranging part for arranging a liquid supply unit; and a carriage part for accommodating a liquid ejection head and moving along a vicinity of the supply unit arranging part, wherein a carriage side communication device for communicating a supply unit communication portion provided in the liquid supply unit is formed in a portion of the carriage part corresponding to the supply unit arranging part.

2. The liquid ejection apparatus according to claim 1, wherein the supply unit arranging part is provided with a through window portion corresponding to the supply unit communication portion, and the carriage side communication device is formed in a portion corresponding to the through window portion of the carriage part for moving in the vicinity of the through window portion.

3. The liquid ejection apparatus according to claim 2, the through window portion is capable of penetrating therethrough a convex portion on which the supply unit communication portion is provided.

4. The liquid ejection apparatus according to claim 1, wherein a plurality of supply unit housing portions for accommodating a plurality of liquid supply units are arrayed in the supply unit arranging part in a moving direction of the carriage part, and the through window portion is formed on the carriage side of each of the supply unit housing portions.

5. The liquid ejection apparatus according to claim 4, wherein the through window portion formed in the supply unit housing portion is provided with a shutter portion to be brought into an opening state when the liquid supply unit is arranged in the supply unit housing portion, and a shutter side communication device is provided in the shutter portion.

6. The liquid ejection apparatus according to claim 4, wherein a housing portion side engaging positioning portion is formed in the supply unit housing portion corresponding to a supply unit side engaging positioning portion provided in the liquid supply unit, a mounting portion for mounting the liquid supply unit is formed in the supply unit housing portion, and a pressing member for pressing an upper surface of the liquid supply unit to be mounted on the mounting portion against the mounting surface side is formed.

7. The liquid ejection apparatus as claimed in claim 1, wherein the carriage part moves with respect to the supply unit arranging part during an ejection operation when the liquid ejection head ejects liquid.

8. The liquid ejection apparatus as claimed in claim 7, wherein the carriage side communication device moves with respect to the supply unit communication portion during the ejection operation.

9. A liquid ejection apparatus, comprising:

a housing that houses a first liquid container, wherein the first liquid container comprises a first communication circuit; and a carriage that moves relative to the housing during a liquid ejection operation and that contains a second communication circuit, wherein the second communication circuit communicates with the first communication circuit when the carriage moves relative to the housing during the liquid ejection operations, wherein the second communication circuit communicates with the first communication circuit via wireless communication.

10. The liquid ejection apparatus as claimed in claim 9, wherein the second communication circuit is located at a portion of the carriage that is adjacent to the housing.

11. The liquid ejection apparatus as claimed in claim 9, wherein the housing houses a second liquid container, wherein the second liquid container comprises a third communication circuit; and wherein the second communication circuit communicates with the first communication circuit and the third communication circuit when the carriage moves relative to the housing during the liquid ejection operation.

12. The liquid ejection apparatus as claimed in claim 11, wherein the first liquid container and the second liquid container are arranged in a direction in which the carriage moves relative to the housing during the liquid ejection operation.

13. The liquid ejection apparatus as claimed in claim 9, wherein the housing comprises a window, wherein the first liquid container comprises a protrusion that protrudes into the window, and wherein the protrusion comprises the first communication circuit.

14. The liquid ejection apparatus as claimed in claim 13, wherein the second communication circuit of the carriage moves in a vicinity of the window when the carriage moves relative to the housing during the liquid ejection operation.

15. The liquid ejection apparatus as claimed in claim 13, wherein the window comprises a shutter that opens when the housing houses the first liquid container, and wherein the shutter comprises a third communication circuit.

16. A liquid ejection apparatus, comprising:

a first liquid container that comprises a first communication circuit;

a second liquid container that comprises a second communication circuit; and a carriage that moves relative to the first liquid container and the second liquid container during a liquid ejection operation and that contains a third communication circuit, wherein the third communication circuit communicates with the first communication circuit and the second communication circuit when the carriage moves relative to the first liquid container and the second liquid container during the liquid ejection operation, wherein the third communication circuit communicates with the first communication circuit and the second communication circuit via wireless communication.

17. The liquid ejection apparatus as claimed in claim 16, further comprising a housing that houses the first liquid container and the second liquid container.

* * * * *